United States Patent [19]

Rahnke

[11] 4,360,316

[45] Nov. 23, 1982

[54] TWO CYCLE PER REVOLUTION WAVE COMPRESSION SUPERCHARGER

[75] Inventor: Christian J. Rahnke, Orchard Lake, Mich.

[73] Assignee: Ford Motor Company, Dearborn, Mich.

[21] Appl. No.: 166,730

[22] Filed: Jul. 7, 1980

[51] Int. Cl.[3] ..... F04F 11/00

[52] U.S. Cl. ..... 417/64

[58] Field of Search ..... 417/64; 60/39.45 A; 123/559

[56] References Cited

U.S. PATENT DOCUMENTS

| | | | |
|---|---|---|---|
| 3,078,034 | 2/1963 | Spalding | 417/64 |
| 3,164,318 | 1/1965 | Barnes et al. | 417/64 |
| 3,556,680 | 1/1971 | Leutwyler et al. | 417/64 |
| 4,002,414 | 1/1977 | Coleman et al. | 417/64 X |
| 4,274,811 | 6/1981 | Rao | 417/64 |

FOREIGN PATENT DOCUMENTS

| | | | |
|---|---|---|---|
| 1384959 | 2/1975 | United Kingdom | 417/64 |

OTHER PUBLICATIONS

"Performance and Sociability of Comprex Supercharged Diesel Engines" by Groenewold et al., published by American Society of Mechanical Engineers, Sep. 18-22, 1977.

*Primary Examiner*—Carlton R. Croyle
*Assistant Examiner*—Edward Look
*Attorney, Agent, or Firm*—Frank G. McKenzie; Donald J. Harrington

[57] ABSTRACT

A supercharger for compressing air supplied to an engine, wherein the energy of the exhaust gas is used to increase the pressure of the air admitted to the engine, has a rotor with radially extending vanes that define a plurality of rotating cells therebetween. Exhaust gas inlet and outlet ports at one axial end of the rotor and air inlet and outlet ports at the opposite end of the rotor admit engine exhaust gas and ambient air to the rotor cells and permit the flow of exhaust gas and compressed air from the rotor cells. The inlet and exhaust ports of the exhaust gas port plate are correspondingly equal in size and symmetrically disposed around the rotor circumference. The inlet and exhaust ports of the air port plate are unsymmetrically arranged around the rotor circumference and are of unequal size. A first air inlet port has an air outlet port associated with a first compression cycle. The second air inlet port has an air outlet port associated with the second compression cycle.

5 Claims, 3 Drawing Figures

TWO CYCLE PER REVOLUTION WAVE COMPRESSION SUPERCHARGER

BACKGROUND OF THE INVENTION

1. Field of the Invention

This invention relates to a wave compression supercharger wherein the energy of the exhaust gas of the engine is used to compress air inducted into the engine. More particularly, the invention pertains to such a supercharger wherein two complete cycles of wave compression occur during a single rotor revolution.

2. Description of the Prior Art

My invention comprises improvements in a wave compression supercharger of the kind that is described in a publication of *The American Society of Mechanical Engineers,* dated Sept. 18–22, 1977 entitled, "Performance and Sociability of Comprex Supercharged Diesel Engines".

A wave compression supercharger is a device for producing an exchange of pressure between the pressurized, hot exhaust gas of an internal combustion engine and air at atmospheric pressure. Within the supercharger the ambient air is compressed and the exhaust gas expanded.

A conventional wave compression supercharger includes a cylindrical rotor having radially directed vanes extending from its outer surface. Generally, stationary port plates are positioned at opposite ends of the rotor and have inlet openings formed through their thicknesses to allow exhaust gas and ambient air to flow into the rotor. Additional openings are provided in the port plates through which the expanded exhaust gas and compressed air flow from the rotor. The pressure exchange takes place within the rotor cells defined by the spaces between the rotor vanes. The process for compressing the ambient air begins when a rotor cell rotates into general alignment with the air inlet port thereby allowing ambient air to flow into and to fill the rotor cell. Rotation then brings the rotor cell into general alignment with the exhaust gas inlet port thus admitting into the cell a compression wave, which begins to travel along the rotor length in the direction of the inlet air port. The compression wave travels along the rotor ahead of the engine exhaust gas and operates to compress the air in the rotor cell as it travels axially toward the air port plate. The rotor will have rotated out of communication with the air inlet port when the compression wave has begun to travel down the rotor length thereby sealing the air side of the rotor cell.

Immediately before the compression wave reaches the air side of the rotor, the cell rotates out of alignment with the exhaust gas inlet port. Next, the rotor brings the cell to the air outlet port thus allowing the compressed air to be pumped from the rotor due to the action of the compression wave traveling to the air side of the rotor. The rotor then brings the cell out of communication with the air outlet port and for a brief period the rotor cell is closed at both ends. In a similar way, the exhaust gas is purged from the rotor cell after the pressure wave rebounds from the air port plate surface. The rotor cell rotates into alignment with the exhaust gas outlet port when the rebounding compression wave returns to the exhaust gas port plate. At the air side of the rotor, the cell is open to ambient air during the latter portion of the compression wave movement to the gas side so that a partial vacuum tending to resist movement of the returning compression wave is avoided.

For efficient operation, it is necessary that the compression wave reaches the air side of the cell precisely as the cell rotates out of alignment with the high pressure air exhaust port. This port must be sized and positioned carefully with respect to the rotor cell and the air inlet port so that the rotor brings the cell to the port when the air in the cell has been compressed to a sufficient pressure but before the engine exhaust gas, located behind the compression wave, reaches the end of the cell.

In view of the timed sequence of events within a wave compression supercharger with respect to the rotor speed, the position and location of the gas and air inlet and outlet ports and of the progression and return of the pressure wave along the rotor length, it can be appreciated that the device will operate efficiently generally at only one speed. However, the engine of the vehicle that drives the rotor must operate over a wide range of speed. It is, therefore, desirable to expand the efficient operating range of the supercharger to a greater portion of the speed range of the engine.

Recognizing the need to expand the optimal speed range of a wave compression supercharger, air and gas port plates have been mounted for angular adjustment so that the location of the ports formed through their thicknesses can vary as the rotor speed varies. A supercharger of this kind has been described in U.S. patent application Ser. No. 99,245, filed Dec. 3, 1979. Superchargers having the general characteristics in operation as described herein have been disclosed in U.S. patent application Ser. No. 90,948, filed Nov. 5, 1979 and Ser. No. 32,324, filed Apr. 23, 1979, all assigned to the assignee of the present patent application.

Conventional wave compression supercharges have two sets of ports formed in each air port plate and exhaust gas port plate. These sets of port are identically spaced around the circumference of the rotor and are sized so that the two inlet ports and the two outlet ports have respectively equal areas. Furthermore, the ports are spaced symmetrically around the rotor circumference. This disposition of the air inlet and exhaust port permits two complete suction and compression cycles within each rotor cell for every revolution of the rotor. A high frequency siren-like noise is an operating characteristic of a wave compression supercharger of this convention type. The noise is recognized to be a serious problem in automotive usage.

The spacing of the ports and the circumferential length over which they extend is conventionally selected to produce the most efficient operation of the supercharger at a given engine speed. The engine speed corresponding to the sizing of the ports is the speed at which the supercharger is required to produce positive boost, usually at or near the engine idle speed.

Conventional wave compression superchargers have two compression cycles for each revolution of the rotor. The air port plate has two large inlet ports of equal size and two smaller output ports of equal size formed through its thickness. The ports are distributed about the central axis of the rotor and extend in the circumferential direction a predetermined portion of the total circumference. Each port extends radially an amount that corresponds generally to the radial depth of the rotor cells.

Each compression cycle has one associated air inlet port and one air outlet port; the inlet ports are disposed between the outlet ports. Therefore, each compression cycle occurs during one-half of each rotor revolution because the several ports are arranged around the rotor circumference symmetrically about the central axis of the rotor. The arcuate distance between the adjacent edges of the inlet and outlet ports is the same for each compression cycle.

SUMMARY OF THE INVENTION

The two cycle wave compression supercharger for compressing air supplied to the engine of a motor vehicle according to my invention includes a rotor mounted for rotation having vanes extending radially from and distributed circumferentially about the rotor axis, the vanes defining rotor cells therebetween that extend along the rotor axis. At one axial end of the rotor, an exhaust gas port plate has two inlet exhaust gas ports formed therein through which exhaust gas from the engine enters the rotor cells as they rotate into registry with the inlet exhaust gas ports. Two outlet exhaust gas ports are formed in the port plate through which exhaust gas from the engine exits the rotor cells. The inlet and exhaust gas ports are distributed around the circumference of the rotor, each exhaust port being interposed between the inlet ports.

At the axially opposite end of the rotor, an air port plate has two air inlet ports formed therein through which air at low ambient pressure enters the rotor cells. Air outlet ports are formed in the air port plate through which compressed air exits the rotor cells as they rotate into registry with the air ports. Each exit port is interposed between two adjacent inlet ports, all of the ports being arranged in spaced relationship around the rotor circumference. One air inlet port and the next succeeding outlet port in the direction of rotation are associated with one compression cycle. The second air inlet port and the second air outlet port are associated with a second compression cycle.

The portion of each rotor revolution that is associated with the first compression cycle is unequal to that portion associated with the second rotor cycle. This results because the arcuate length measured from the leading edge of the air exit port of the first compression cycle to the corresponding edge of the exit port of the second cycle is other than one-half of the total arcuate length of a rotor cycle. Consequently, for a given rotor speed the first compression cycle requires a different amount of time to complete than the second compression cycle. Furthermore, the arcuate length of the inlet port associated with one compression cycle is different from the arcuate length of the air inlet port of the second compression cycle. Also, the circumferential distance between adjacent edges of the outlet and inlet ports associated with a particular compression cycle is different from that of the other compression cycle. In addition, the circumferential length between the trailing edge of the inlet port of one compression cycle is spaced from the leading edge of the adjacent exit port of the other compression cycle a distance that is different from the corresponding circumferential spacing between the second compression cycle and the first compression cycle.

An object of the two cycle compression wave supercharger having this geometrical arrangement of the air inlet and outlet ports is to provide one compression cycle having optimal operating characteristics compatible with rotor speeds at the lower end of the engine speed range and a second compression cycle compatible with efficient operation at the higher end of the engine speed range. Consequently, the supercharger according to my invention would result in more efficient operation over a wider range of engine speed than if the supercharger had the conventional, symmetrical disposition of inlet and outlet air ports.

Unwanted noise, particularly high frequently noise, is further reduced with this invention since the unequal sizes of the air ports moderate the siren-like effect that is produced by multi-cycle superchargers having equal size ports.

In realizing these advantages it has been found that the exhaust gas ports can be symmetrically arranged around the rotor axis in the conventional manner wherein each compression cycle subtends an arc that is precisely one-half of one rotor revolution. The exhaust gas inlet ports and outlet ports are respectively of equal size for each of the two compression cycles and, in the conventional manner, the exhaust gas inlet ports are approximately one-third the size of the exhaust gas outlet ports. Likewise, the spacing between adjacent inlet and outlet ports of each compression cycle and the spacing between ports separating the two compression cycles are respectively of equal size.

DESCRIPTION OF THE PREFERRED EMBODIMENTS

Figure 1:
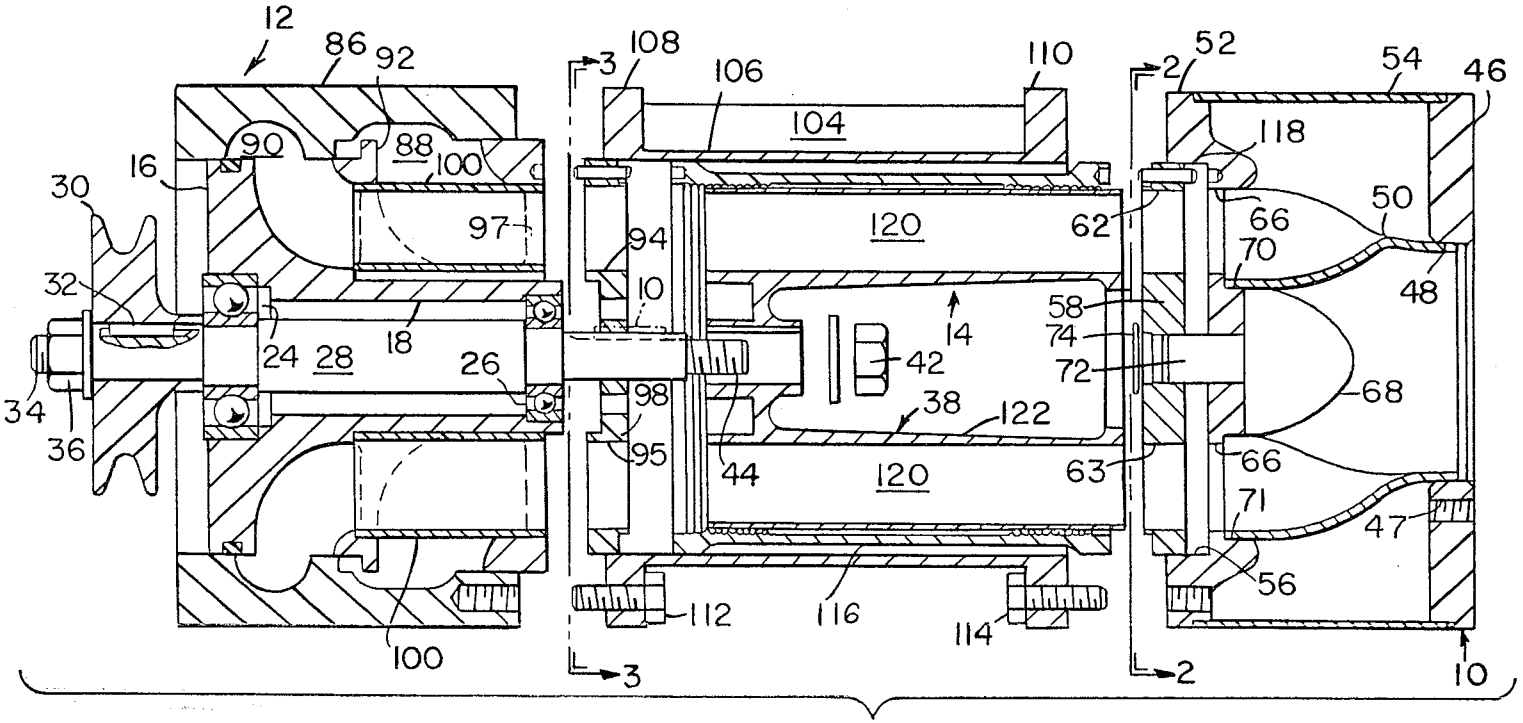
FIG. 1 is a longitudinal cross sectional view of the two cycle per revolution supercharger according to my invention.

Turning first to FIG. 1, a wave compression supercharger according to the present invention includes an exhaust gas duct assembly 10 positioned at one axial end, an air duct assembly 12 located at the opposite end and a rotor assembly 14 positioned between the duct assemblies.

The air duct assembly 12 includes a bearing housing 16 which has an axial bore 18 extending along its length extablishing its principal inside diameter. Recesses 20 and 22 are formed on the bore 18 into which are fitted bearings 24, 26. A pulley 30 is secured at the keyway 32 to the overhung outer surface of the shaft 28, which is mounted within the housing on the bearings. In this way, torque from the engine crankshaft is delivered to the pulley by way of a belt and rotation of the shaft about its central axis results. The shaft is driven in rotation at approximately three times the engine speed. The pulley 30 is retained on the shaft by the engagement of a nut 36 on the externally threaded portion 34 of the shaft 28, which engagement causes the pulley to be drawn up securely and to be retained between the bearing 24 and the retaining nut 36. Similarly at the axially opposite end of the shaft 28, rotor 38 is secured against relative rotation with respect to the shaft at the keyway 40 and the retaining nut 42 is drawn up on an externally threaded portion 44 of shaft 28 thereby fixing the rotor 38 on the shaft.

The exhaust gas duct assembly 10 includes a circular rear mounting plate 46 having a plurality of tapped holes 47 arranged around a central circular opening 48 into which an inner exhaust duct shroud 50 is fitted. The tapped holes 47 provide a means for attaching the supercharger to the motor vehicle structure.

Figure 2:
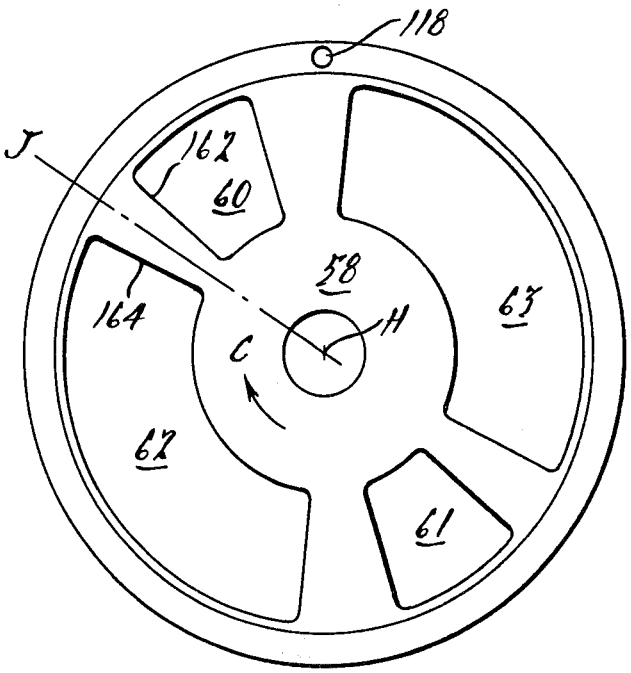
FIG. 2 is a front elevational view taken at plane 2—2 of FIG. 1 showing the exhaust gas port plate.

A port retainer flange 52 located in a plane parallel to the plane occupied by the rear mounting plate 46 is spaced axially therefrom by an outer shroud 54 having the form of a right circular cylinder mounted upon and joined to plate 46 and the flange 52. A cylindrical bore 56 is formed partially through the thickness of the port retainer flange 52 and provides a recess wherein an exhaust gas port plate 58 is mounted. FIG. 2 illustrates a front view of the exhaust gas port plate 58 showing the exhaust gas inlet ports 60, 61 and gas outlet ports 62, 63 formed through the thickness of the port plate 58.

The retainer flange 52 has a gas inlet ports and exhaust gas outlet ports 66 that are identically arranged and substantially aligned with the inlet and outlet ports 60-63 of the gas port plate 58. The inner shroud 50 is joined to the port retainer flange 52 on the surfaces 70 and 71. Mounted within the shroud 50 on the axial centerline of the supercharger is a center body 68 having a stub portion 72 that extends through a central opening in the exhaust gas port plate 58 onto which it is mounted by a retaining ring 74. Between the ends of the shroud 50 an axial well is gradually formed having a depth and width slightly greater than that of the gas outlet ports 62, 63 of the port plate 58 and flange plate 52. The center body 68 abuts the inner surface of the well (not shown) and prevents the flow of exhaust gas through the inlet orifice (not shown) from passing through the outlet ports 62, 63. Instead, incoming exhaust gas is required to flow through the inlet ports 60, 61, which are best illustrated in FIG. 2. When exhaust gas exits through the port 62, 63, the outer surface of the inner shroud seals the incoming exhaust gas from the exiting exhaust gas. The outer shroud 54 is intersected by a duct that directs the flow of the incoming exhaust gas to the supercharger from the exhaust gas system of the motor vehicle on which it is mounted.

At the left end of the supercharger, as shown in FIG. 1, the air duct assembly 12 includes an air duct 86, having plennum chambers 88, 90 that align axially with mating interior surfaces of the bearing housing 16. A web portion 92 of the bearing housing seals chambers 88, 90 and provides a surface onto which air duct 86 is mounted. An inlet orifice (not shown) communicates with chamber 88 and carries inlet air at ambient conditions into the supercharger. Ambient air enters the rotor through the air inlet ports 94, 95, shown best in FIG. 3, which are formed through the thickness of the air port plate 98. Air exits the supercharger by passing through an exit duct (not shown) that extends through the thicknesses of the air port plate 98, the inner wall 96 and the web 92 of the bearing housing 16. The cylinders 100 are aligned with the exit ports 96, 97, formed in the air port plate 98. Air exiting the rotor passes into chamber 90 and exits the air duct 86 through an intersecting duct that carries the compressed air into the inlet manifold of the internal combustion engine.

A rotor housing 104 has a cylindrical shroud portion 106 that extends axially between flange portions 108, 110. The flanges are mechanically attached at a bolt circle 112 to the air duct 86 that furnishes a tapped hole in alignment with the bolts and by a similar bolt circle 114 that aligns with a plurality of tapped holes formed in the port retainer flange 52.

A spacer shroud 116 extends between the exhaust gas port plate 58 and the air port plate 98. Shroud 116 receives spring pins 118, 119 in its axially opposite faces. The spring pins extend through plates 58, 98 and into the adjacent retainer flange 52 and bearing housing 16. The spring pins position and align the exhaust gas and air ports with respect to one another.

The rotor 38 has a plurality of rotor vanes 120 extending radially outwardly from and spaced circumferentially about the rotor hub 122. The vanes are circumferentially spaced around the hub in one zone that extends over approximately 126 degrees around the rotor in increments that are nine degrees apart one vane from another. A second zone, adjacent the first, extends over approximately 104 degrees of rotor circumference and has vanes within this zone spaced apart approximately eight degrees of rotor circumference. A third zone, adjacent the first and second zone, extends over approximately 130 degrees of rotor circumference and has vanes spaced apart approximately ten degrees of rotor circumference. The vanes are joined to the rotor hub 122 by brazing the radially outermost edges of the vanes to a circular sleeve 124 that extends axially the full length of the rotor. The radially inner edge of each vane is brazed to the rotor hub 122.

Turning now to FIG. 2, the exhaust gas port plate 58 is shown having two inlet ports 60, 61 and two outlet ports 62, 63 through which engine exhaust gas enters and exits the rotor. The ports are arranged symmetrically around the rotor circumference, inlet ports being of equal size and exit ports being of equal size. Ports 60, 63 are associated with a first compression cycle; the ports 61, 62 are associated with a second compression cycle. When viewing the plate 58 from its interior surface, as in FIG. 2, vector C represents the direction of rotation of the rotor with respect to the plate.

Figure 3:
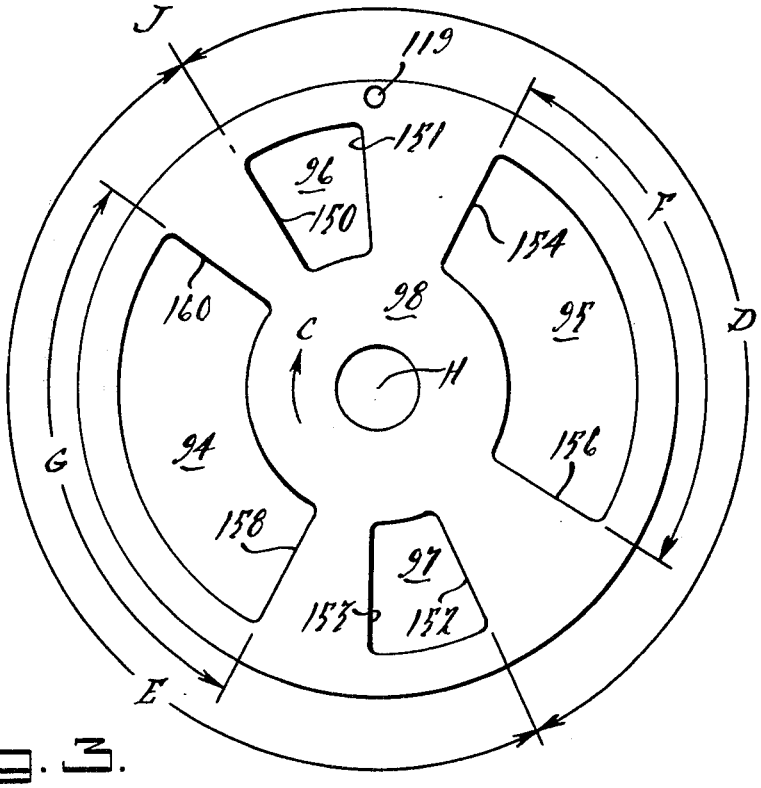
FIG. 3 is a front elevational view taken at plane 3—3 of FIG. 1 showing the air port plate.

FIG. 3 is a front view of the air port plate 98 taken from its exterior surface. The direction of the rotation of the rotor when viewed from the exterior surface is represented by vector C. An outlet port 96 and air inlet port 95 are associated with the first compression cycle and with the exhaust gas inlet and outlet ports 60, 63. Air outlet port 97 and air inlet port 94 are associated with the second compression cycle and with the exhaust gas inlet and outlet ports 61, 62.

The arcuate length of the first compression cycle extends more than one-half of one rotor rotation. Of course, the second compression cycle extends over less than one rotor revolution. The angle measured from the leading edge of outlet port 96 to the leading edge of the outlet port 97 is, therefore, more than 180 degrees. Correspondingly, the angle E measured from the leading edge of the inlet port 97 to the leading edge of the inlet port 96 is less than 180 degrees. Furthermore, the arcuate length of outlet port 95 is different from the length of the outlet port 94. Angle F measured between the leading edge 154 and the trailing edge 156 of outlet port 95 is approximately 90 degrees. The angle G measured between the leading edge 158 and the trailing edge 160 of the outlet port 94 is approximately 100 degrees. Accordingly, the dwell time between the trailing edge 151 of outlet port 96 and the leading edge 154 of inlet port 95 is greater than the corresponding dwell time between edges 153, 158 of the second compression cycle. The dwell period between the first and second cycles represented by the distance extending between trailing edge 156 and leading edge 152 is greater than the dwell period between the second and first cycles represented by the distance extending between trailing edge 160 and leading edge 150.

The disposition of the exhaust gas port plate 58 in relation to the air port plate 98 is illustrated best with respect to radial line H-J drawn from the center of rotation outwardly. Line H-J is coincident with the leading edge 150 of the air outlet port 96 and when projected onto the exhaust gas port appears nearly midway between the leading edge 162 of the gas inlet port 60 and the trailing edge 164 of the gas outlet port 62.

The rotor defines a cell in the space bounded by adjacent vanes 120, the rotor hub 122 and the outer sleeve 124. The relationship between the cells and the ports of the plates 58, 98 is carefully chosen so that a pressure wave admitted to the rotor at the gas end of the supercharger is used to compress the air that enters the cells through the air intake ports 94, 95. The turbocharger porting and cell characteristics are designed to achieve a compression wave phenomenon that effects an energy transfer from the exhaust gas to the intake manifold air.

During the first compression cycle, rotor rotation brings a cell into registry with exhaust gas inlet port 60 thereby emitting a compression wave to the rotor that travels along the rotor length toward the air side at the speed of sound in the exhaust gas. Immediately before the compression wave reaches the air port plate 98, outlet port 96 will open and allow the compressed air to flow from the rotor into the intake manifold of the engine. Outlet port 96 should open an instant after inlet port 60 is closed, but before the high pressure wave reaches the air side end of the cell.

Next, exhaust gas port 63 opens; shortly after that, inlet air port 95 opens. During the period in which port 63 and 95 are open, the compression wave and the engine exhaust gas behind it return to the gas side of the rotor and the cell is filled with air at ambient conditions during a low pressure scavange process wherein the exhaust gas is completely swept from the rotor.

The compression process continues with the exhaust gas outlet port 63 closing an instant before the air outlet port 95 closes. These closings are followed by a short dwell period during which the ambient air completely fills the rotor cell. Supercharging takes place as the cell passes the high pressure exhaust gas outlet port 61. Again, a compression wave is produced and travels along the rotor length ahead of the high pressure engine exhaust gas, thereby compressing the air present in the cell. Air outlet port 97 opens with the air has been compressed to a suitable pressure and the compressed air is forced from the rotor cell.

For efficient operation it is necessary that the incident compression wave creating by the opening of the high pressure exhaust gas inlet ports 60, 61 reaches the air end of the cell at the precise moment that the high pressure air exhaust ports 96, 97 open. The high pressure air outlet ports 196, 197 must be sized exactly and the rotor speed timed precisely so that only the compressed air is admitted to the engine intake manifold. The cell must rotate past the ports 94, 95 before the exhaust gas, which has progressed axially down the rotor, reaches the left end of the cell as shown in FIG. 1.

In a manner similar to that which was described with respect to the first compression cycle, exhaust gas inlet port 61 closes, followed by closure of air outlet port 97. A short dwell period, during which the cell is closed at each axial end, permits the compression wave to return to the exhaust gas side of the rotor. As the compression wave approaches port plate 58, gas outlet port 62 opens and a low pressure scavange process permits all of the engine exhaust gas to exit the rotor cell. Following this, air inlet port 94 opens permitting air at ambient conditions to flow axially toward the gas side. While air inlet port 94 is open, gas outlet port 62 closes. Shortly thereafter air inlet port 94 closes thus creating a short dwell period during which the ambient air progresses across the rotor to the exhaust gas side.

It can be seen that the first compression cycle having the smaller air exhaust port 95 can be arranged to produce an optimal compression cycle when the rotor is turning at a slower speed. Since the compression wave travels across the rotor at sonic speed which is a constant for a given temperature, the larger size of air exhaust port 94 is therefore more compatible with a high speed rotor whose speed relative to the constant speed of the compression wave necessitates a larger air exhaust port.

Changes and modifications in the specifically described embodiment can be carried out without departing from the scope of the invention which is intended to be limited only by the scope of the appended claims.

Having described a preferred embodiment, what I claim and desire to secure by U.S. Letters Patent is:

1. A two cycle compression wave supercharger for compressing air supplied to an engine comprising:

a rotor mounted for rotation about an axis having vanes extending radially therefrom and distributed circumferentially about the axis, the vanes defining rotor cells therebetween that extend along the axis;

an exhaust gas port plate located at a first axial end of the rotor having two inlet gas ports through which exhaust gas from the engine enters the rotor cells and two outlet gas ports through which exhaust gas exists the rotor cells, the inlet and outlet gas ports being located alternately around the axis and grouped in pairs, each pair associated with one compression cycle, the angles subtended by each pair being equal;

an air port plate located at the axially opposite end of the rotor having two air inlet ports through which air at low pressure enters the rotor cells and two air outlet ports through which compressed air exits the rotor cells, the inlet and outlet air ports being located alternately around the axis and grouped in pairs, each pair cooperating with a gas port pair for operation at one optimum rotor speed, the angle subtended by a first air port pair being different from the angle subtended by the second air port pair, the angular dimension of the air inlet ports of the first and second pairs being different one from another, the angular dimension of the air outlet ports of the first and second pairs being different one from another.

2. The supercharger of claim 1 wherein for each compression cycle the gas inlet port opens before the air outlet port opens and closes before the air outlet port closes.

3. The supercharger of claim 1 wherein for each compression cycle the gas outlet port opens before the air inlet port opens and closes before the air outlet port closes.

4. The supercharger of claim 1 wherein the angular dimension of the air outlet ports of the first and second pairs are equal.

5. The supercharger of claim 1 wherein the angular dimension of the air inlet ports of one pair is approximately ninety degrees and that of the other pair is approximately one hundred degrees.

* * * * *